US008749471B2

(12) United States Patent
Jang et al.

(10) Patent No.: US 8,749,471 B2
(45) Date of Patent: Jun. 10, 2014

(54) LIQUID CRYSTAL DISPLAY AND METHOD OF DRIVING THE SAME

(75) Inventors: Hyeonyong Jang, Osan-si (KR); Ho-young Kim, Cheonan-si (KR); Hyung-Ku Kang, Seoul (KR); Hak-Mo Choi, Seoul (KR)

(73) Assignee: Samsung Display Co., Ltd. (KR)

( * ) Notice: Subject to any disclaimer, the term of this patent is extended or adjusted under 35 U.S.C. 154(b) by 301 days.

(21) Appl. No.: 12/959,204

(22) Filed: Dec. 2, 2010

(65) Prior Publication Data

US 2011/0175859 A1 Jul. 21, 2011

(30) Foreign Application Priority Data

Jan. 18, 2010 (KR) ..... 10-2010-0004444

(51) Int. Cl.
*G09G 3/36* (2006.01)

(52) U.S. Cl.
USPC ..... 345/102; 345/204; 345/690

(58) Field of Classification Search
CPC ..... G09G 2310/0237; G09G 2320/0261; G09G 2310/08
USPC ..... 345/102, 204, 690
See application file for complete search history.

(56) References Cited

U.S. PATENT DOCUMENTS 6,535,193 B1 * 3/2003 Mizutome et al. ..... 345/99
7,224,342 B2 * 5/2007 Chen et al. ..... 345/102

(Continued)

FOREIGN PATENT DOCUMENTS

JP 2003-279927 A 10/2003
JP 2004-064431 2/2004

(Continued)

OTHER PUBLICATIONS

Motion Interpolation Performance of 120Hz Display Systems by Byung Hyuk Shin, Jaeho Oh, Kyungwoo Kim, Minkyu Park and Brian H. Berkeley, SID Symposium Digest of Technical Papers. Volume 39, Issue 1, May 2008, pp. 366-369.*

(Continued)

*Primary Examiner* — Quan-Zhen Wang
*Assistant Examiner* — Chun-Nan Lin
(74) *Attorney, Agent, or Firm* — Innovation Counsel LLP

(57) ABSTRACT

An impulsively driven liquid crystal display includes a display panel displaying an image in response to a gate signal and a data signal, a panel driving circuit providing the gate signal and the data signal to the display panel using an image signal and a control signal, a backlight unit including a plurality of light sources that blink at once to provide a light to the display panel, and a backlight control circuit. The backlight control circuit automatically detects an existence of text information from a received image signal, and if the text is detected to be present, adjusts the blinking timing of the light sources to correspond with the area on the display panel where the text will be displayed, the adjustment being a function of a liquid crystal response delay time of liquid crystals used in the display panel.

20 Claims, 9 Drawing Sheets

(56) References Cited

U.S. PATENT DOCUMENTS

| | | | | |
|---|---|---|---|---|
| 7,385,599 | B2 * | 6/2008 | Mukai | 345/204 |
| 7,830,357 | B2 * | 11/2010 | Kitaoka et al. | 345/102 |
| 8,264,447 | B2 * | 9/2012 | Kimura et al. | 345/102 |
| 2002/0070914 | A1 * | 6/2002 | Bruning et al. | 345/102 |
| 2002/0105527 | A1 * | 8/2002 | Hata et al. | 345/589 |
| 2005/0057484 | A1 * | 3/2005 | Diefenbaugh et al. | 345/102 |
| 2005/0057485 | A1 * | 3/2005 | Diefenbaugh | 345/102 |
| 2005/0134547 | A1 * | 6/2005 | Wyatt | 345/102 |
| 2005/0184952 | A1 * | 8/2005 | Konno et al. | 345/102 |
| 2006/0092333 | A1 * | 5/2006 | Kang et al. | 348/699 |
| 2006/0279523 | A1 * | 12/2006 | Nitta et al. | 345/102 |
| 2007/0132709 | A1 * | 6/2007 | Kawaguchi | 345/102 |
| 2007/0285382 | A1 * | 12/2007 | Feng | 345/102 |
| 2008/0129677 | A1 * | 6/2008 | Li et al. | 345/102 |
| 2008/0259082 | A1 * | 10/2008 | Engholm et al. | 345/440 |
| 2009/0002265 | A1 * | 1/2009 | Kitaoka et al. | 345/4 |
| 2009/0135128 | A1 * | 5/2009 | Jeon et al. | 345/102 |
| 2009/0153462 | A1 * | 6/2009 | Kamada et al. | 345/102 |
| 2011/0018878 | A1 * | 1/2011 | Miyamoto | 345/428 |
| 2011/0080423 | A1 * | 4/2011 | Kerofsky | 345/593 |

FOREIGN PATENT DOCUMENTS

| | | | |
|---|---|---|---|
| JP | 2004-309592 | | 11/2004 |
| JP | 2005-049631 | A | 2/2005 |
| JP | 2009-198935 | | 9/2009 |
| KR | 1020080062848 | A | 7/2008 |

OTHER PUBLICATIONS

Dynamic gamma: Application to LCD motion-blur reduction by Xiao-fan Feng, Hao Pan, Scott Daly Journal of the SID 14/10, 2006, pp. 949-956.*

Thermal Management in Microprocessor Chips and Dynamic Backlight Control in Liquid Crystal Displays by Wonbok Lee, Ph.D dissertation, Aug. 2008, University of Southern California, 124 pages.*

A design for an RGB LED driver with independent PWM control and fast settling time by Awo Dede O. Ashiabor, Master Dissertation, Massachusetts Institute of Technology, May 2007, 87 pages.*

Comparisons of motion-blur assessment strategies for newly emergent LCD and backlight driving technologies by Xiao-fan Feng, Hao Pan, Scott Daly, Published by Journal of the SID 16/10, 2008, pp. 981-988,.*

Motion Blur Reduction for Liquid Crystal Displays: Motion Compensated Inverse Filtering by Michiel A. Klompenhouwer and Leo Jan Velthoven Philips Research Laboratories, Proc. of SPIE-IS&T Electronic Imaging, SPIE vol. 5308 2004 SPIE and IS&T, 10 pages.*

Moving-Picture Response Time and Perceived Motion Blur on LCD Panels by Jun Someya Information Display Oct. 2005, 5 pages.*

LCD motion-blur analysis, perception, and reduction using synchronized backlight flashing by Xiao-fan Feng, Proc. of SPIE-IS&T Electronic Imaging, SPIE vol. 6057, 60570M, 2006 SPIE-IS&T , 14 pages.*

Liquid Crystal Display Drivers Techniques and Circuits by Dr David J.R. Cristaldi, Prof Salvatore Pennisi, Dr Francesco Pulvirenti ISBN: 978-90-481-2254-7, 2009.*

* cited by examiner

LIQUID CRYSTAL DISPLAY AND METHOD OF DRIVING THE SAME

CROSS-REFERENCE TO RELATED APPLICATION

This application relies for priority upon Korean Patent Application No. 2010-4444 filed on Jan. 18, 2010, the contents of which are herein incorporated by reference in their entirety.

BACKGROUND

1. Field of Disclosure

The present disclosure of invention relates to a liquid crystal display and a driving method thereof. More particularly, the present disclosure relates to a liquid crystal display capable of improved display of text imagery thereof and a method of driving the liquid crystal display.

2. Description of Related Technology

A liquid crystal display generally displays an image in a hold type manner (e.g., a stored image frame) using a plurality of pixels having liquid crystals. Certain types of liquid crystals can be slow in responding to changes of electric field applied to them. Therefore, when flashed (blinked) frames of a motion picture are displayed one after the next in the liquid crystal display (or in one variation, with shutter-like all black frames interposed between the sequential image frames), motion blur may be perceived to occur due to the slow response time of the liquid crystals and a rapid change in the to-be displayed imagery.

In order to prevent the motion blur in the liquid crystal display, an impulsive method that increases a driving frequency of the liquid crystal display from the conventional 60 Hz to say, 120 Hz or more has been introduced. The impulsive method operates by inserting darkened impulsive frames (e.g., those having black or darkened gray data) in between substantially brighter display frames that have refreshed image data applied to them to thus create a movie shutter effect when displaying an image on the liquid crystal display panel. However, when this shutter-emulating impulsive method is implemented by actually transmitting darkened frame data to the liquid crystal display, power consumption increases due to the increase of the driving frequency and due to activation of the LCD backlighting at the same time. Also, when this shutter-emulating impulsive method is implemented, the time period left to drive the pixels to the desired, bright frame state may be insufficient due to the equal time reduction applied to all the display frames.

It is to be understood that this background of the related technology section is intended to provide useful background for understanding the here disclosed technology and as such, this technology background section may include ideas, concepts or recognitions that were not part of what was known or appreciated by those skilled in the pertinent art prior to corresponding invention dates of subject matter disclosed herein.

SUMMARY

The above shortcomings may be overcome in accordance with one aspect of the present disclosure by globally blinking the backlighting light over a less than full frame period (<1F) so as to thereby mimic the movie shutter effect. Global blinking reduces hardware cost over systems that use localized blinking.

Embodiments disclosed herein provide a liquid crystal display capable of improving the image quality thereof, particularly in regards to the displaying of a few sharp crisp text lines that may be disposed near a top portion of a frame, near a bottom portion of a frame or approximately in the middle portion of a frame.

Embodiments disclosed herein also provide a method of driving the liquid crystal display so as to provide for sharp crisp text lines.

According to the present disclosure, a liquid crystal display includes a display panel, panel driving circuitry, a globally blinkable backlight unit, and a backlight blink timing control circuit. The display panel forms a to-be-displayed image (a refreshed image) in response to received gate signals and received data signals. The panel driving circuitry provides the gate signals and the data signals to the display panel in the form of a synchronously transmitted image signal and a corresponding timing control signal. The backlight unit includes a plurality of light sources, where these light sources can be blinked on all at once (globally) to thus provide a flash of backlighting light to the display panel so that lights-out durations in between can mimic the shutter effect of a conventional motion picture projector. In order to improve the crispness of a to-be-displayed one or a few lines of text, the backlight control circuitry includes a text position detecting circuit that detects existence of text information within a supplied image signal, and if text is present; detects the corresponding placement of the text information as being in one of a predetermined number of subareas of the display area, where this placement detection or determination is based on the timing position of the text within the transmitted image signal; and the backlight control circuitry uses the placement determination results of the text position detecting circuit to synchronize the blinking-on timing of the globally blinkable light sources. This blinking-on timing is made dependent on a predetermined liquid crystal response time taken for a line image signal displayed at a center point of the display panel area.

In one embodiment, the backlight control circuitry includes a text information detector (or other sharp edged imagery detector), a blinking timing controller, and an inverter. The text/sharp edged imagery information detector detects the text (or other sharp edged) information from the image signal corresponding to the text/other information area of the display panel based on the image signal to output a detection signal corresponding to the existence of the text information. The blinking timing controller outputs a timing control signal to synchronize the global blinking timing of the light sources with a delay attributed to the liquid crystal response times of the liquid crystal molecules used in the display apparatus. The inverter globally blinks the light sources on at once and for a short turned-on duration at a time corresponding to the liquid crystal response delay time of the liquid crystal molecules so that the text (or other sharp edged) information area that is to have the greatest clarity is illuminated at the time of its full response to image defining signals.

According to embodiments, a driving method of a liquid crystal display includes providing a display panel with a gate signal and a data signal using an image signal and a control signal, controlling transmittance of liquid crystals in response to the gate signal and the data signal to display an image, automatically detecting an existence of a text (or other sharp edged) information from an image signal, automatically determining a corresponding position on the screen of the detected text information, and automatically globally blinking a plurality of light sources at once in synchronization with a liquid crystal response time delay characteristic of liquid crystal molecules of the display apparatus so as to provide essentially best clarity for either a center portion of the display area by default or a portion of the display area where the text (or other sharp edged) information was detected to be present to thus provide an illuminating light pulse to the display panel at a timing that is in accordance with the detected result.

Detecting the existence of the text information may include dividing a suspect text information area into n sub-areas to detect the existence of possible text information in the image signal corresponding to each sub-area, and deciding that the text information in the image signal corresponding to the text information area exists if the text information is detected in the image signal corresponding to at least one sub-area to output a detection signal.

According to the above, the liquid crystal display detects if the text (or other sharp edged) information exists in the image signal corresponding to a suspect subarea of the display screen. When the text (or other sharp edged) information is not automatically detected, the light sources globally blink at a timing corresponding to the center portion of the display panel. When the text (or other sharp edged) information is detected, the light sources are responsively and globally blinked at a timing corresponding to the screen subarea where the text (or other sharp edged) information is determined to be positioned. Therefore, an image quality (e.g., contrast ratio) around the text information area (e.g., closed caption area) on which users keep their eyes can be improved, thereby providing the users with the improved image quality without increasing manufacturing cost (e.g., without resorting to locally as opposed to globally blinked backlighting lamps).

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
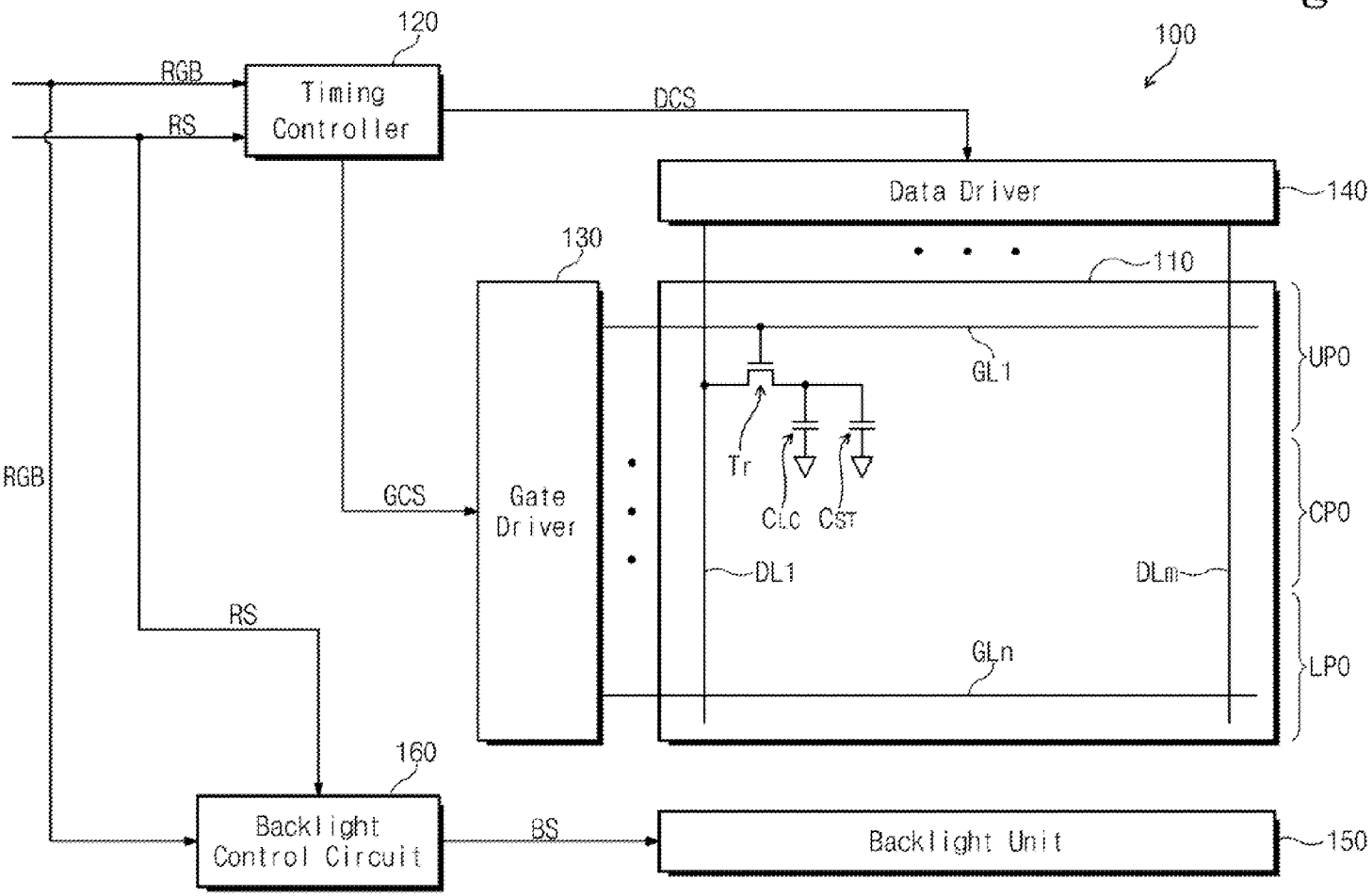
FIG. 1 is a block diagram illustrating a liquid crystal display according to an exemplary embodiment of the present disclosure.

The present teachings are described more fully hereinafter with reference to the accompanying drawings, in which exemplary embodiments are shown. The present teachings may, however, be embodied in many different forms and should not be construed as limited to the embodiments set forth herein. Rather, these embodiments are provided so that disclosure is thorough, and will fully convey the teachings to those skilled in the art. In the drawings, the size and relative sizes of layers and regions may be exaggerated for clarity. Like reference numerals in the drawings generally denote like elements.

It will be understood that when an element or a layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Hereinafter, the present disclosure of invention will be explained in detail with reference to the accompanying drawings.

FIG. 1 is a block diagram illustrating a liquid crystal display system 100 according to an exemplary embodiment. In one sub-embodiment thereof, the illustrated system 100 may be part of a television (TV) set that is equipped to selectively show "closed caption" text scrolling across a top/upper portion (UPO) of the screen or across a bottom/lower portion (LPO) of the screen or across a middle/center portion (CPO) of the screen, where such "closed caption" text is understood to assist deaf or hard of hearing viewers in understanding what is intended to be relayed to them by the combination audio and visual material presented to them. Since the so provided "closed caption" text can be vital to the understanding of certain viewers, it is desirable that such caption text, if present, be as sharp and clear as possible.

Referring to the details of FIG. 1, the liquid crystal display system 100 includes a liquid crystal display panel 110, a timing controller 120, a gate lines driver 130, a data lines driver 140, a globally blinkable backlight unit 150, and a backlight control circuit 160. One advantage of using a globally blinkable backlight unit 150 is reduced cost and less complexity as compared to locally blinkable backlight units that may require many inverters and many separate but coordinated control circuits for the same in order to achieve desired results.

The timing controller 120 of FIG. 1 receives an image signal such as in an original RGB format and a corresponding reference signal RS from an external source or device (not shown). The reference signal RS may be a signal in synchronization with a frame rate of the liquid crystal display 100, such as a vertical synchronization signal or a horizontal synchronization signal. The timing controller 120 converts a data format of the received image signal RGB into a data format appropriate for an interface used between the timing controller 120 and the data lines driver 140 and outputs the converted image signal, i.e. as a digitized data control signal DCS to the data lines driver 140. Furthermore, the timing controller 120 outputs a corresponding gate control signal GCS to the gate lines driver 130.

The gate lines driver 130 sequentially applies gate signals to a sequence of parallel gate lines GL1~GLn of the liquid crystal display panel 110. The timing of the gate signals is in response to the gate control signal GCS received from the timing controller 120 and the gate signals are used to sequentially scan the gate lines GL1~GLn.

The data lines driver 140 generates a plurality of gray scale voltages using gamma adjusted voltages obtained from a gamma adjustable voltage generating circuit (not shown). The data lines driver 140 selects appropriate gray scale voltages corresponding to digital codes provided in the image signal RGB and forwarded in appropriate format in the data control signal DCS which is received from the timing controller 120. The selected appropriate gray scale voltages (analog signals) are then applied to the data lines DL1~DLm of the liquid crystal panel 110.

The illustrated liquid crystal display panel 110 includes a plurality of gate lines GL1~GLn, a plurality of data lines DL1~DLm crossing the gate lines GL1~GLn, and a plurality of pixel units.

In the exemplary embodiment 100, all the pixel units have a same repeated structure and function, and thus one exemplary pixel unit is shown in FIG. 1 as an example for the sake of convenience. Each pixel unit includes a thin film transistor Tr, a liquid crystal capacitor $C_{LC}$, and a charge storage capacitor $C_{ST}$. The thin film transistor Tr includes a gate electrode connected to a corresponding gate line of the gate lines GL1~Gln, a source electrode connected to a corresponding data line of the data lines DL1~DLm, and a drain electrode connected to a pixel-electrode portion of the liquid crystal capacitor $C_{LC}$ and also to an associated electrode of the storage capacitor $C_{ST}$.

When a corresponding gate turn-on signal is applied to a correspondingly selected gate line of the gate lines GL1~GLn, a thin film transistor Tr connected to the selected gate line is turned on in response to the corresponding gate turn-on signal. As a result, the analog data signal then applied to the corresponding data line is coupled by way of the turned-on thin film transistor to the drain of the transistor and is thus charged into the liquid crystal capacitor $C_{LC}$ and into the storage capacitor $C_{ST}$ through the turned-on thin film transistor Tr.

The liquid crystal capacitor $C_{LC}$ controls a light transmittance attribute of liquid crystals (not shown) disposed in the liquid crystal display panel 110 according to the charged voltage of the liquid crystal capacitor $C_{LC}$. The storage capacitor $C_{ST}$ is charged with the same data signal provided through the corresponding data line when the thin film transistor Tr is turned on. The storage capacitor $C_{ST}$ helps maintain the level of the charged data signal applied to the liquid crystal capacitor $C_{LC}$ so as to thus maintain the charged state of the liquid crystal capacitor $C_{LC}$ even after the thin film transistor Tr is turned off (More specifically, the turn on time of the transistor Tr is typically for a short 1H horizontal scan period while the desired charge retention time of the storage capacitor $C_{ST}$ is typically a longer, full 1F frame period.) Through the described method, the liquid crystal display panel 110 can form a to-be-displayed, desired image. However the formed and to-be-displayed image is not projected to a user's eyes (not shown) until the backlighting unit 150 flashes on (blinks on) and a corresponding set of light rays project through the display panel 110 and into the user's eyes for latent retention therein. (As known to skilled artisans and as experienced by movie watchers who watch a conventionally shuttered output of a conventional movie projector, even though intervals of darkness are interposed between the flashed frames of a movie reel, the human visual system integrates the output over time and perceives an unbroken stream of images, including moving images. The conventional movie shutter hides from the human visual system the image of each movie reel frame as it scrolls up or down to make way for the next movie reel frame. If the latter were shown, an undesired blurring effect might be perceived.)

When a flashed on frame of an LCD apparatus (e.g., 100) includes a line of text, the perceived crispness of that text turns out to be dependent on when the backlighting lights (150) are flashed momentarily into the turned-on state (the blinked on state) and on when the charge refreshing operation for that line of text began. The reason is that the liquid crystals take time to respond to the refreshed charge (the new analog voltage signal just passed through transistor Tr) and if the lights are blinked on too soon, the backlighting rays will not catch the fully regenerated new state of the slow-to-respond liquid crystals.

To solve this problem, the backlight control circuit 160 of the present embodiment 100 includes circuitry (see also FIG. 2) that automatically detects if a line of text information is present within the image refreshing RGB signal and if yes, it automatically determines where along the vertical height of the display area (e.g., which gate line) the detected text (e.g., closed caption text) will be centrally aligned with. In one embodiment, the backlight control circuit 160 is configured to automatically predetermine, before the text information is projected to the viewer by the blinking on of the backlights 150, whether the text will predominantly be inside of an upper one third portion (UPO) of the display area, inside a center third portion (CPO), or inside a lower third portion (LPO) of the display panel. In one embodiment, the backlight control circuit 160 is configured to further automatically predetermine, before the text information is projected to the viewer by momentary blinking on (<1F) of the backlights, if the text will extend across an adjacent two of the upper, center, and lower third portions (UPO/CPO/LPO) of the display area. Then, based on a results of this automatic detection, the backlight control circuit 160 outputs a correspondingly timed, blinking control signal, BS to the backlight unit 150 to thus define a blinking on timing of the light sources that is in delayed synchronization with a refresh-beginning time point of the new text, where the delay that depends on the liquid crystal response time of the LCD panel. In one embodiment, the end of the blinked on time (trailing edge of a Turn-on pulse shown in FIG. 4A) is set to correspond with a center portion of the display area if there is no text detected as being present or it is set to correspond with placement position of the text information in the vertical height of the display area if the text is detected as being present. In one embodiment, the timing of the blinking control signal, BS is synchronized to the reference signal RS used by the timing controller 120.

The backlight unit 150 is disposed at a rear of the liquid crystal display panel 110 and provides lighting to the liquid crystal display panel 110 by means of edge lighting and/or from-the-back direct lighting. The backlight unit 150 includes the light sources and makes the light sources blink on all together at once and for a predetermined pulse duration based on the timing of the blinking signal BS provided from the backlight control circuit 160. The light sources may include cold cathode fluorescent lamps, light emitting diodes, or other. An advantage of globally blinked backlighting is that it may be done with just one inverter circuit and one control circuit as compared to localized blinking which could require many inverters and many control circuits.

Figure 2:
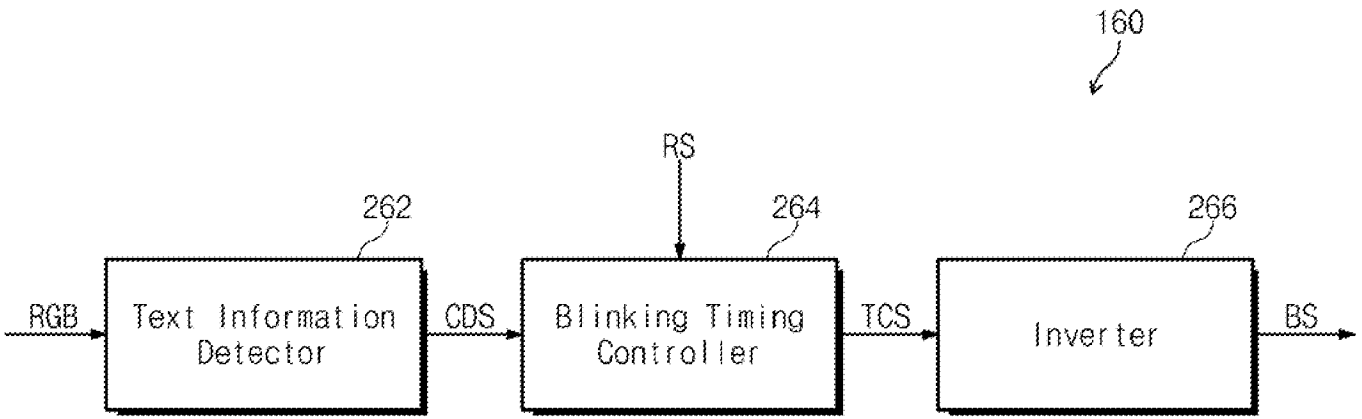
FIG. 2 is a block diagram illustrating a backlight control circuit of FIG. 1.

FIG. 2 is a block diagram illustrating a backlight control circuit 160 that could be used in the embodiment of FIG. 1.

The illustrated backlight control circuit 160 includes a text information detector 262, a blinking timing controller 264, and an inverter (or other appropriate level shifter) 266.

The text information detector 262 outputs a caption-present detection signal CDS indicating the existence of the text information (e.g., a closed caption area) to the blinking timing controller 264. The text information detector 262 receives the image signal RGB from the external device (not shown) and detects the presence or not of text or text-like glyphs (e.g., closed caption material) in the imagery represented by the received RGB signal. In an alternate embodiment, the caption-present detection signal CDS is provided from an internal circuit of an associated TV circuit.

The blinking timing controller 264 outputs a timing control signal TCS to the inverter 266 to thereby define the blinking on and off timings of the light sources. This timing corresponds with the liquid crystal response time of the LCD display. In one embodiment, the defined blinking on and off timings either correspond to a center portion (CPO) of the display area if no text is detected or they correspond to the text information containing area (e.g., UPO or LPO) of the display panel 110 if text is detected and its presence is so indicated by the caption detection signal CDS. In one embodiment, the defined blinking on and off timings of the light sources are synchronized with the reference signal RS that is received from the external device.

The inverter 266 outputs the blinking signal BS at an appropriate voltage level to thus control the blinking on and off timings of the light sources in response to the timing control signal TCS.

Figure 3:
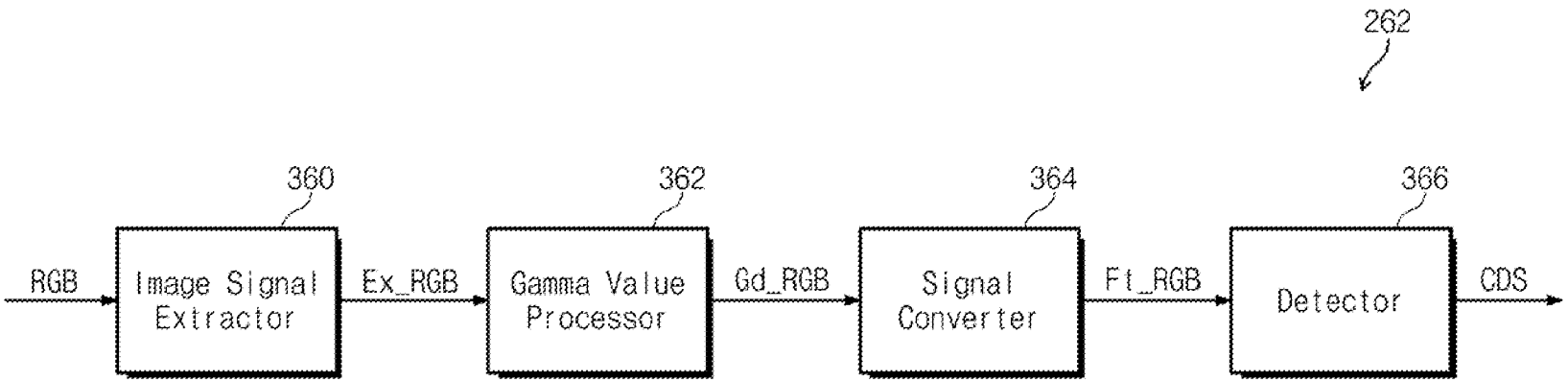
FIG. 3 is a block diagram illustrating a text information detector of FIG. 2.

FIG. 3 is a block diagram illustrating details of one embodiment of the text information detector 262 of FIG. 2.

The text information detector 262 includes an image signal extractor 360, a gamma value processor 362, and signal converter 364, and a detector 366.

The image signal extractor 360 defines a certain area of the display panel 110 as a to-be-tested information area to which detection operations will be directed for determining the existence or not of text information in that to-be-tested information area. In one embodiment, the to-be-tested information area is divided into n sub-areas, where n is an integer larger than two. The image signal extractor 360 extracts an image signal corresponding to each sub-area from the image signal RGB provided from the external device and provides the extracted image signal Ex_RGB to the gamma value processor 362.

The gamma value processor 362 processes the extracted image signal Ex_RGB and converts it to a so-called linearized (decompressed) value that usually has a greater number of bits than the original gamma value signal. (Those skilled in the art will understand that such linearization is needed in order to create linearly combinable arithmetic values.) The gamma value processor 362 then provides the processed image signal Gd_RGB of each corresponding sub-area to the signal converter 364.

The signal converter 364 converts the received set of time-domain processed image signals Gd_RGB to an image signal in frequency domain and provides the frequency domain image signal Ft_RGB to the detector 366. The signal converter 364 may use Fourier Transform (e.g., FFT) to convert the processed image signal Gd_RGB represented by time domain to the frequency domain image signal Ft_RGB represented by frequency domain.

The detector 366 decides whether the text information exists in each sub-area based on the frequency domain image signal Ft_RGB. The detector 366 decides that the text information exists if at least one maximal value of the converted image signal corresponding to at least one sub-area is larger than a predetermined reference value. If the text information is detected to be present in at least one sub-area, the detector 366 provides the blinking timing controller 264 with the detection signal CDS having information indicating a position of the text information, the text information area, or the sub-areas, where the text information is detected.

According to another exemplary embodiment, the image signal extractor 360, the gamma value processor 362, and the signal converter 364 may be removed from the text information detector 262 so as to leave behind only the detector 366 and the detector 366 may employ various other detecting techniques to detect the existence or not of text information in the image signal RGB and the virtual placement (e.g., timing position, etc.) of that text in the image signal RGB. In an alternate embodiment, the associated TV circuitry provides a caption position indicating signal that indicates the relative position of captioned text when such is present.

Figure 4A:
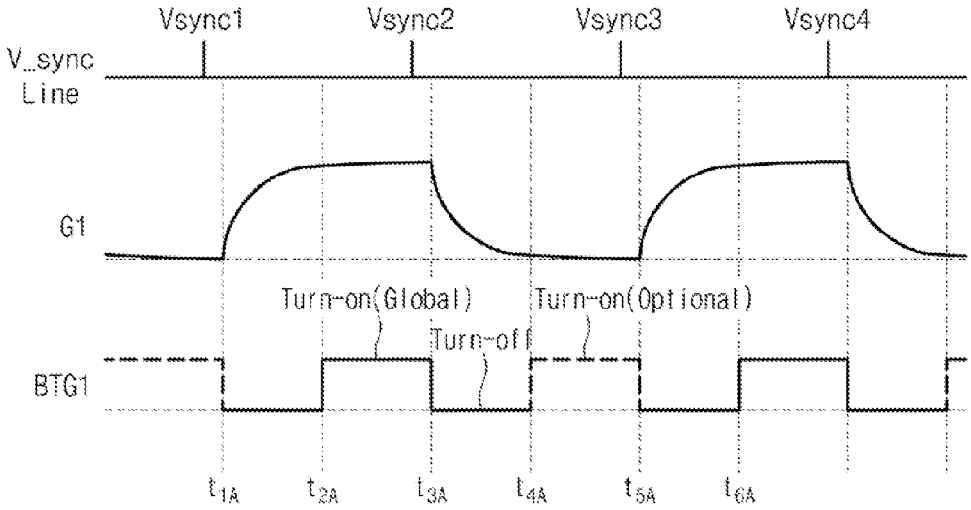
FIG. 4A is a timing diagram illustrating liquid crystal response for new text data provided in an upper portion (UPO) of a display panel and illustrating the preferred global blinking timing of a backlight unit when the new text information is correspondingly detected to be present in a portion of the received image signal corresponding to the upper portion of the display panel.

FIG. 4A is a timing diagram illustrating a first operation of the system when the captioned text is detected to be present in an upper portion (UPO) of the display. In FIG. 4A, the V_sync Line has sequential time markers on it, Vsync1, Vsync2, Vsync3, etc., where the time span between two immediately adjacent ones these (e.g., Vsync1 and Vsync2) can represent one image-showing frame time period (1F). In the example of FIG. 4A, a text containing area has been detected in the upper one third region (UPO) of the display area. The gate line corresponding to this upper position (UPO) is activated for a 1H duration at a first time point denoted as $t_{1A}$ in FIG. 4A. As can be seen in FIG. 4A, the first gate-activating time point $t_{1A}$ occurs shortly after the Vsync1 signal is asserted and well before the Vsync2 signal is asserted Also in FIG. 4A, the liquid crystal response curves of pixels of this upper portion UPO of the display panel 110 have been predetermined and are represented in FIG. 4A by the slow rising portion of first graph plot G1 between the first gate-activating time point $t_{1A}$ and second time point $t_{2A}$. Between second and third time points $t_{2A}$ and $t_{3A}$, liquid crystal molecules of the gate line activated (turned on) at first time point $t_{1A}$ have settled into a substantially steady state. Also in the example of FIG. 4A, the timing of the blinked on and off points for the globally blinked backlight unit 150 have been determined based on the positional placement of the text information (e.g., captioned text) that was detected as being included in the RGB image signal where; in the given first example of FIG. 4A, that placement predominantly corresponds to the upper one third portion, UPO of the display panel 110 of FIG. 1 and more specifically to the gate line(s) that is/are activated at approximately the first gate-activating time point $t_{1A}$. Accordingly, since the liquid crystal molecules of that/those gate line(s) do not settle into their desired new angular orientation until around the second time point, $t_{2A}$, the light sources of the backlight unit 150 are not turned turn on until that second time point, $t_{2A}$, which corresponds to the substantially maximized response of the liquid crystal molecules of pixels of the text information area to the pixel-electrode driving voltages that were applied at the first gate-activating time point $t_{1A}$.

At third time point $t_{3A}$, new data voltages are applied to pixels of the same gate line(s) whose pixels were earlier driven at first time point $t_{1A}$. The third time point, $t_{3A}$ is displaced after second frame synch pulse Vsynch2 by the same chronological distance as is the first time point $t_{1A}$ displaced after the first frame synch pulse Vsynch1. The timing may be synchronized with reference to the externally-supplied reference signal RS when the display panel 110 is driven in a progressive scanning method. In the present exemplary embodiment, each vertical synchronization signal is used as the reference signal RS and the first vertical synchronization signal Vsync1 is thus input to a vertical synchronization signal line V_sync Line when image data for the top of the frame is to be supplied. After a predetermined frame-duration period, the second vertical synchronization signal Vsync2 is input to the vertical synchronization signal line V_sync and so on. A time period between the first vertical synchronization signal Vsync1 and the second vertical synchronization signal Vsync2 corresponds to one frame time period (1F).

Referring to FIG. 4A, the first plotted response graph, G1 shows the liquid crystal response versus time (e.g., rotating into a new liquid crystal orientation angle) that occurs in response to a correspondingly applied new pixel-electrode voltage where that new pixel driving voltage is applied to a pixel belonging to the upper portion, UPO of the display panel 110. The Blinking Timing Graph, BTG shows that the globally blinked backlight unit 150 is turned on at the second time point, $t_{2A}$, which corresponds to the portion of the first graph G1 where the liquid crystal molecules have substantially reached or are reaching their maximum rotation into the new orientation angle. At the third time point, $t_{3A}$, a new pixel electrode drive voltage is applied through turned on TFTs and the BTG signal is switched to off (no backlighting) at or before that third time point, $t_{3A}$.

Several different interpretations of FIG. 4A are contemplated here for what happens between third time point, t3A and fifth time point, t5A. In one embodiment, all black grayscale voltages are applied to the corresponding pixels of the then-activated gate line(s) so as to emulate a black shutter effect; in which case the illustrated-as-dashed, next turn on of the backlighting (BTG ON between t4A and t5A) may happen for pixels of other portions of the display or may not happen for energy saving. The first option is known as the all-black frame-insert technique for impulse displays. In a second alternate embodiment, a darkened grayscale, but not all-black frame is inserted. In that second case (darker grayscale frame-insert technique), the dashed, next turn on of the backlighting (BTG ON between t4A and t5A) does happen because it is necessary for showing the darker grayscale frame-insert. In yet a third possibility, the one frame duration (1F) between Vsync2 and Vsynch3 is used a pixels pre-charge time in which pixels are pre-charged to respective voltages approximating what their final charge will be in yet the next one frame duration (1F) between Vsync3 and Vsynch4. The next frame voltage goals could include reverse polarity new drive voltages. For this third possibility (pre-charge option), the dashed, next turn on of the backlighting (BTG ON between t4A and t5A) preferably does happen but also the G1 plot between Vsync2 and Vsynch3 may not be applicable. At the fifth time point, t5A, in FIG. 4A; and irrespective of which of the above described at least three options is used, the next new pixel driving voltages are supplied as they were at first time point t1A and the process repeats substantially as it did for the first time point t1A of FIG. 4A. In one embodiment, if pixel precharging or all-black frame insertion is used, the time duration between the associated vertical synch pulses (e.g., Vsync2 and Vsync3) may be less than the full frame period (1F) used for the actual charging of the pixels to the not-darkened voltages of the desired image (e.g., between Vsync1 and Vsync2).

So to summarize here what FIG. 4A is specifically showing, it shows the case where text information (e.g., closed caption) is detected to be present in an image signal (RGB) and to be chronologically disposed so as to correspond to the upper portion, UPO of the display panel 110. In this case the pixels of the text information area (e.g., closed caption area) are launched toward their new states (next desired liquid crystal molecule orientations) at first time point t1A, but because of the relatively slow response times of the liquid crystal molecules, the latter do not substantially reach their desired new angular orientations until approximately the second time point, t2A, at which second time the globally blinked backlights are blinked on. In other words, the globally blinked backlights are blinked on at a time where the liquid crystal molecules of the to-be-more-clearly-presented text information have substantially rotated into their intended final angular orientations (e.g., with white-driven pixels, for example, being most bright at that time and black-driven pixels being most dark at that time so as to then provide a maximum contrast ratio for the text-containing area (e.g., closed caption area).) The time period immediately before the blink-on period (e.g., the time between t1A and t2A) is a blacked-out display period. Accordingly, when the to-be-most-clearly-presented text information is detected to be present in the received image signal (RGB) and is determined to be chronologically disposed for display in the upper portion, UPO of the display panel 110, the light sources of the backlight unit 150 are turned on at a time (e.g., second time point, t2A) which is predetermined to be in synchronization with the time when the corresponding liquid crystal molecules of the pixels that belong to the upper portion, UPO have substantially reached their desired polarization angles and this then impulsively provides users with improved image quality that focuses its best clarity (lowest MPRT value, as will be described below) on the upper portion UPO of the display area.

Figure 4B:
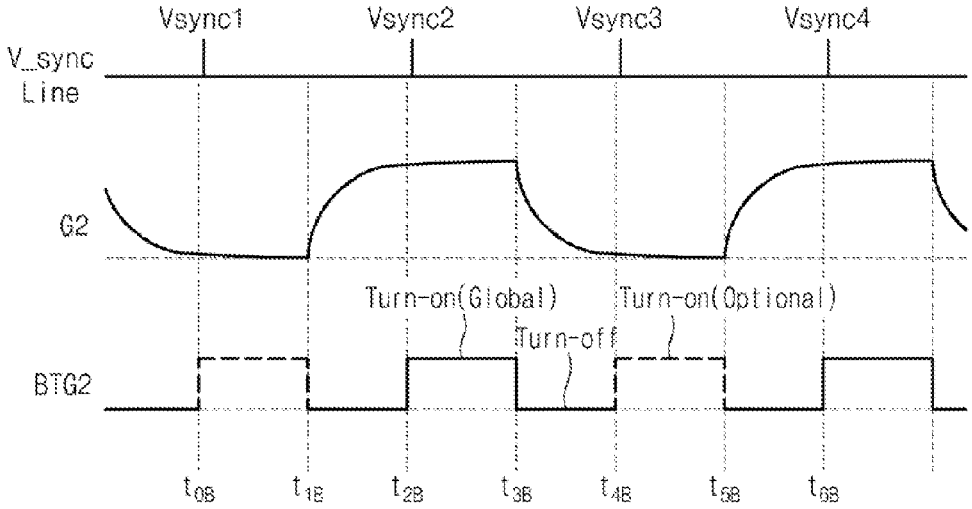
FIG. 4B is a timing diagram illustrating liquid crystal response for new text data provided in a center portion of the display panel and illustrating the preferred global blinking timing when the new text information is correspondingly included in a portion of the image signal corresponding to the center portion of the display panel of FIG. 1.

FIG. 4B is a similar timing diagram illustrating the case where the to-be-most-clearly-presented text information (or other such information) is automatically determined to be located at a center portion, CPO of a display panel 110. In this second case, the blinking timing control for the globally blinked backlight unit 150 is operated in accordance with the second blink timing graph BTG2, wherein the to-be-most-clearly-presented text (or other) information has its pixel-electrode voltages applied at time point t1B of FIG. 4B, this corresponding to the text (or other) information being included in the received image signal (RGB) at a timing corresponding to the center portion, CPO of the display panel 110 of FIG. 1. The light sources of the backlight unit 150 are then automatically and responsively turned on at second time point, t2B, this corresponding to when the liquid crystal molecules of the pixels driven at first time point t1B will substantially attain their desired polarization angles.

Referring to the specifics of FIG. 4B, the second response graph G2 shows the liquid crystal response behavior of pixels belonging to the center portion CPO of the display panel 110 and the second Blinking Timing Graph BTG2 shows the blinking timing of the backlight unit 150 corresponding to the second graph G2.

Specifically, if the to-be-most-clearly-presented text (or other sharp edged) information is detected to be present in the received image signal (RGB) at a position corresponding to the center portion CPO of the display panel 110, the light sources of the backlight unit 150 are turned on in synchronization with a liquid crystal response time of a pixel or pixels that belong to the center portion CPO to provide users with improved image quality focusing on the center portion CPO of the display area.

Figure 4C:
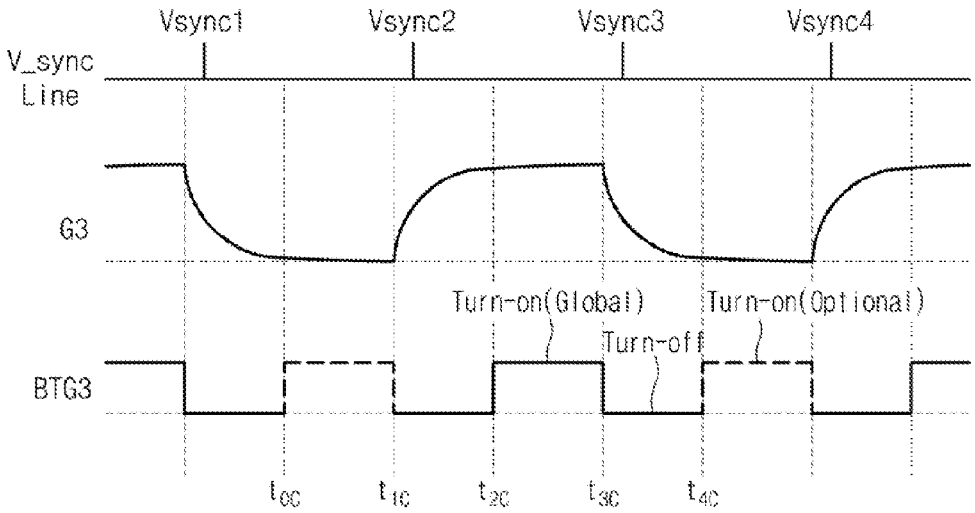
FIG. 4C is a timing diagram illustrating liquid crystal response for new text data provided in a lower portion of a display panel and illustrating the preferred global blinking timing when the new text information is correspondingly included in a portion of the image signal corresponding to the lower portion of the display panel of FIG. 1.

FIG. 4C is a timing diagram similarly illustrating the case where the to-be-most-clearly-presented text (or other sharp edged) information is automatically determined to be located in a lower portion, LPO of a display panel 110 and the blinking timing control of the backlight unit 150 is then operated in accordance with the third blink timing graph BTG3 so as to give maximum contrast ratio and thus maximum clarity to the text information located in the lower portion, LPO of the display panel 110 of FIG. 1. The light sources of the backlight unit 150 turn on correspondingly at second time point t2C in accordance with the liquid crystal response time delay characteristics of the pixels in the area where the to-be-most-clearly-presented text information is detected. However, in this case, unlike in FIGS. 4A and 4B, the to-be-most-clearly-presented text information was detected in the lower portion LPO of the display panel 110.

Thus, respectively in FIGS. 4A-4C, the turn-on time points of the globally blinked light sources are determined according to a desired (predetermined) contrast ratio which is a function of the liquid crystal response rise times of the respective response graphs G1, G2, and G3. For example, the light sources may be turned on during a time period the graphs G1, G2, or G3 are high enough, e.g. 30 percents or more with reference to the desired liquid crystal molecule new orientation angles in each case.

As already explained, the first to third graphs, G1, G2, and G3 respectively correspond to the upper portion, the center portion, and the lower portion of the display panel 110 and they illustrate corresponding liquid crystal responses of sample pixels selected respectively from the upper portion, the center portion, and the lower portion of the display panel 110. Therefore, liquid crystal responses and their appropriate blinking timings can be changed according to the kinds of display panels and the positions of the selected pixels.

The display panel 110 is progressively scanned from the upper portion to the lower portion of the display panel 110 during the time between the first vertical synchronization signal Vsync1 and the second vertical synchronization signal Vsync1. Thus, a good complete image can be displayed if the backlight unit 150 blinks in accordance with any one of the blink timing graphs, BTG1, BTG2 and BTG3 of FIGS. 4A-4C. The point is that the to-be-most-clearly-presented text information (e.g., closed caption text) is automatically identified, its position is automatically determined and the one of blink timing graphs, BTG1, BTG2 and BTG3 which will best display the to-be-most-clearly-presented text information with greatest clarity (e.g., maximum contrast ratio) is automatically selected and used.

Although exact time values are not depicted in FIGS. 4A-4C, referring to FIG. 4A, in order to make the backlight unit 150 turned on in synchronization with the liquid crystal response time of the upper portion UPO of the display panel 110 for one embodiment where the display panel 110 is operated at a frame rater of 120 Hz, it was found that the backlight unit 150 should begin to be turned on at about 1 ms after applying the first vertical synchronization signal Vsync1 to the vertical synchronization signal line V_sync. Similarly, referring to FIG. 4B, and for the same one embodiment the backlight unit 150 should begin to be turned on at about 4 ms after applying the first vertical synchronization signal Vsync1 to the vertical synchronization signal line V_sync in order to make the backlight unit 150 turned on in synchronization with the liquid crystal response time of the center portion CPO of the display panel 110, and referring to FIG. 4C, and for the same one embodiment the backlight unit 150 should be turned on at about 7 ms after applying the first vertical synchronization signal Vsync1 to the vertical synchronization signal line V_sync in order to make the backlight unit 150 blink in synchronization with the liquid crystal response time of the lower portion LPO of the display panel 110. That is, the blinking timings of the backlight unit 150 are different from each other according to the automatically determined position of the to-be-most-clearly-presented text information of the display panel 110.

Referring to FIG. 2 again, when the text information detector 262 decides that the text information does not exist in the image signal corresponding to the text information area, the blinking timing controller 264 outputs a first timing control signal delayed for a first time from the reference signal RS in order to make the backlight unit 150 blink in synchronization with the liquid crystal response time of a pixel or pixels belonging to the center of the display panel 110. In other words, blink timing graph BTG2 is used as a default operating mode. In addition, the blinking timing controller 264 outputs a second timing control signal delayed by a second time from the reference signal RS according to the position of the text information area based on the detection signal CDS output from the text information detector 262 when the text information detector 262 decides that the text information exists in the image signal corresponding to the text information area. In general, the first time is different from the second time, but may be equal to the second time according to the position of the text information.

Figure 5A:
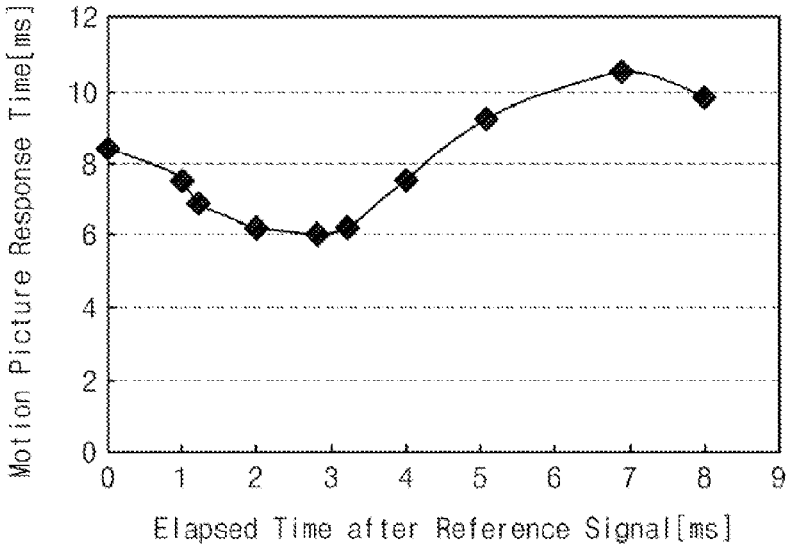
FIG. 5A is a graph showing measured Motion Picture Response Time (MPRT) as a function of time at a center portion of the display panel.

FIG. 5A is a graph showing Motion Picture Response Time (MPRT) as measured at the center portion CPO of the display panel 110 as a function of elapsed time after the reference signal RS is generated, when the frame rate of the display panel 110 is 120 Hz. The Motion Picture Response Time is a kind of industry standard used to estimate a degree of clearness or sharpness of a display apparatus to display a motion picture, promoted by the Video Electronics Standards Association (VESA). As the Motion Picture Response Time is found to be smaller, the corresponding display apparatus is deemed to display a correspondingly clearer and sharper view for a motion picture.

In the present exemplary embodiment, a vertical synchronization signal is used as the reference signal RS, a horizontal axis indicates the elapsed time after the vertical synchronization signal is generated, and a vertical axis indicates the Motion Picture Response Time. As shown in FIG. 5A, the Motion Picture Response Time at the center portion CPO of the display panel 110 is shortest when the backlight unit 150 begins to be turned on at about 3 ms after the reference signal RS is generated.

Figure 5B:
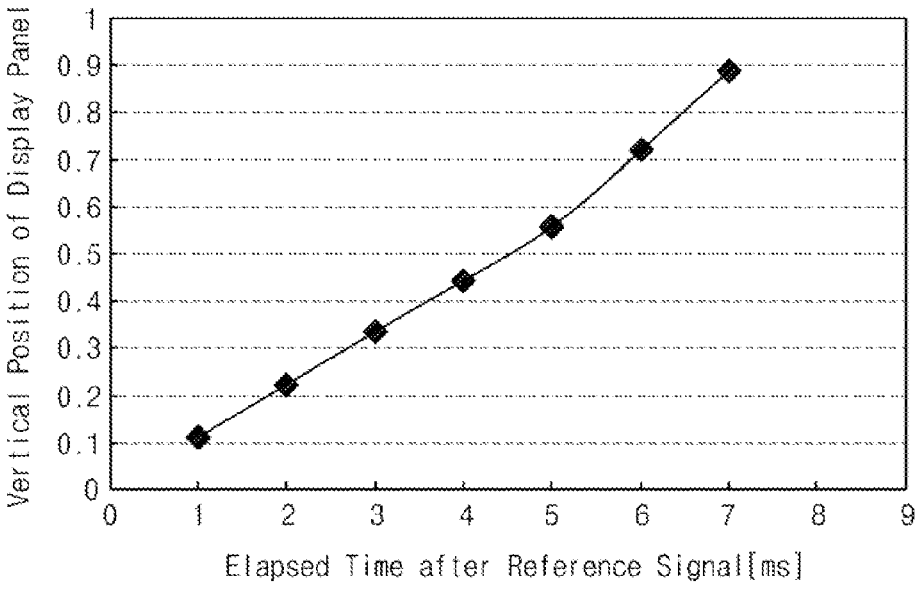
FIG. 5B is a graph showing desired turn-on time of the globally blinked backlight unit according to vertical positions of caption text of the display panel.

FIG. 5B is a graph showing vertical positions of the display panel 110 as a function of elapsed time after the reference signal RS occurs, to make the motion picture response time to be shortest when the frame rate of the display panel 110 is 120 Hz. That is, FIG. 5B shows a relation between the elapsed time after the vertical synchronization signal and the vertical position of the display panel that is then found to have a shortest value of the motion picture response time. In the present exemplary embodiment, a vertical synchronization signal is used as the reference signal RS, a horizontal axis indicates the elapsed time after the vertical synchronization signal occurs, and a vertical axis indicates vertical positions of pixels of the display panel 110. The vertical positions of the pixels of the display panel 110 are linearly indicated. That is, the uppermost portion of the display panel 110 is indicated by relative (normalized) position value "0" and the lowermost portion of the display panel 110 is indicated by a normalized "1".

As shown in FIG. 5B, with reference to the upper portion UPO of the display panel 110, the Motion Picture Response Time was shortest when the light sources of the backlight unit 150 begin to be turned on at a time point from about 0 ms to about 3 ms after the vertical synchronization signal is generated according to the positions of the pixels in the upper portion UPO. Similarly, with reference to the center portion CPO of the display panel 110, the Motion Picture Response Time was shortest when the light sources of the backlight unit 150 begin to be turned on at a time point from about 3 ms to about 6 ms after the vertical synchronization signal is generated according to the positions of the pixels in the center portion CPO. In addition, with reference to the lower portion LPO of the display panel 110, the Motion Picture Response Time was found to be shortest when the light sources of the backlight unit 150 begin to be turned on at a time point from about 6 ms to about 9 ms after the vertical synchronization signal is generated according to the positions of the text pixels being in the lower portion LPO.

Figure 6A:
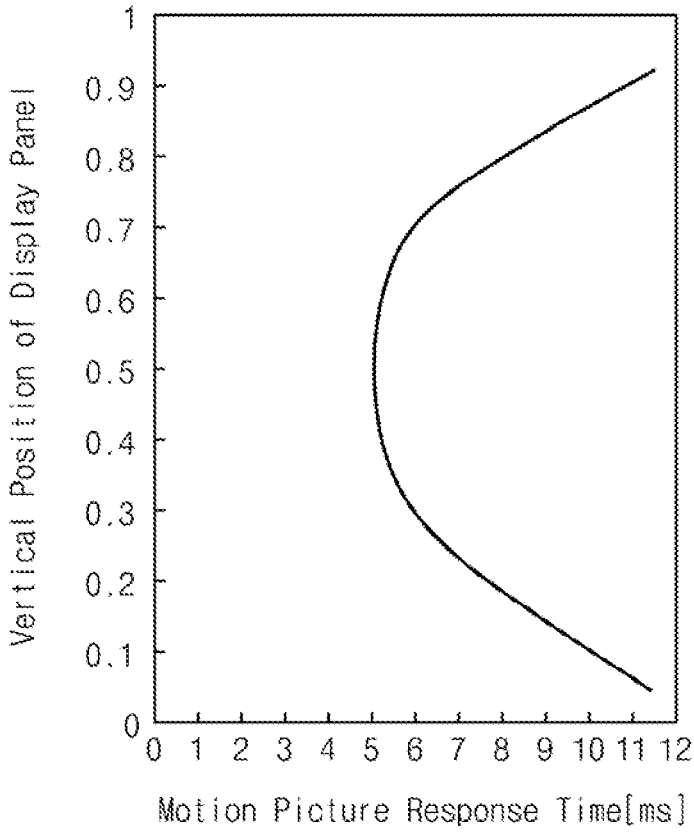
FIG. 6A is a graph showing the Motion Picture Response Time (MPRT) according to the vertical positions of the display panel to improve the Motion Picture Response Time at the center portion of the display panel.

FIG. 6A is a graph showing vertical positions of the display panel 100 as a function of Motion Picture Response Time when the backlight unit 150 blinks to improve the motion picture response time for imagery at the center portion, CPO of the display panel 110, i.e. when the backlight unit 150 blinks in synchronization with the liquid crystal response time of a pixel or pixels belonging to the center portion CPO. In FIG. 6A, the horizontal axis indicates the measured Motion Picture Response Time and the vertical axis indicates normalized vertical positions of pixels of the display panel 110. The vertical positions of the pixels of the display panel 110 are linearly indicated. That is, the uppermost portion of the display panel 110 is indicated by "0" and the lowermost portion of the display panel 110 is indicated by "1".

As shown in FIG. 6A, when the backlight unit 150 blinks in synchronization with the liquid crystal response time of the center portion of the display panel 110, the motion picture response times of the upper and lower portions of the display panel 110 is less desirable as compared to that of the center portion.

Figure 6B:
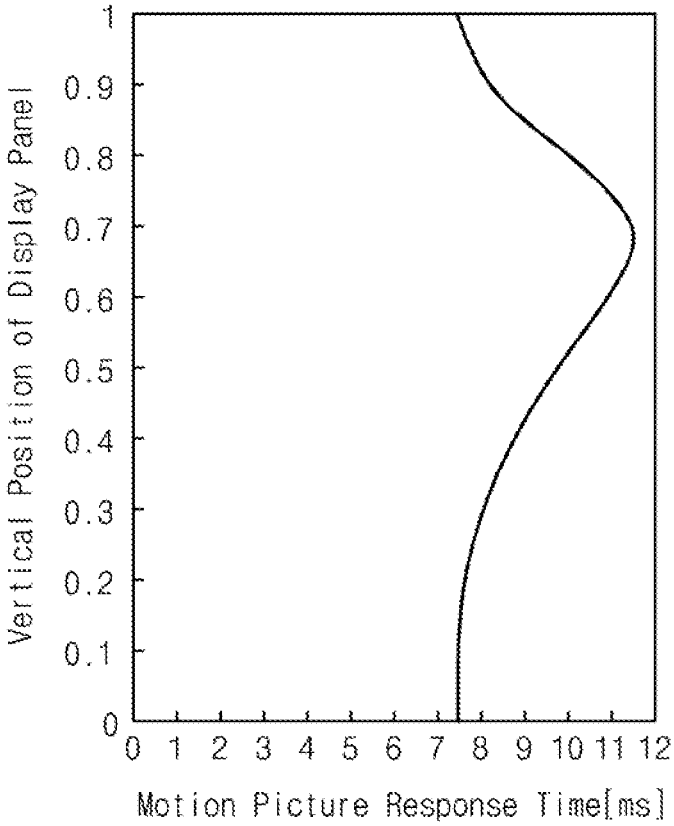
FIG. 6B is a graph showing the Motion Picture Response Time (MPRT) according to the vertical positions of the display panel to improve the Motion Picture Response Time at a lower portion of the display panel.

FIG. 6B is a graph showing vertical positions of the display panel 100 as a function of Motion Picture Response Time when the backlight unit 150 blinks not in line with the center (CPO) of the display area but rather at a different time so as to thereby improve the Motion Picture Response Time for example of imagery at the lower portion LPO of the display panel 110, i.e. when the backlight unit 150 blinks in synchronization with the liquid crystal response time of a pixel or pixels belonging to the lower portion LPO. In FIG. 6B as in FIG. 6A, a horizontal axis indicates the motion picture response time and a vertical axis indicates vertical positions of pixels of the display panel 110. The positions of the pixels of the display panel 110 are linearly indicated. That is, the uppermost portion of the display panel 110 is indicated by "0" and the lowermost portion of the display panel 110 is indicated by "1".

As shown in FIG. 6B, when the backlight unit 150 blinks in synchronization with the liquid crystal response time of the lower portion LPO of the display panel 110, the motion picture response time of the center portion CPO of the display panel 110 is not desirable compared to those of the lower and upper portions LPO and UPO. Also, when the backlight unit 150 blinks in synchronization with the liquid crystal response time of the lower portion LPO of the display panel 110, it can be understood that the Motion Picture Response Time of the upper portion UPO of the display panel 110 is lower than that of the center portion CPO of the display panel 110 because the liquid crystal response time of the lower portion LPO of the display panel 110 partly overlaps with that of the upper portion CPO of the display panel 110 of a next frame.

Figure 7:
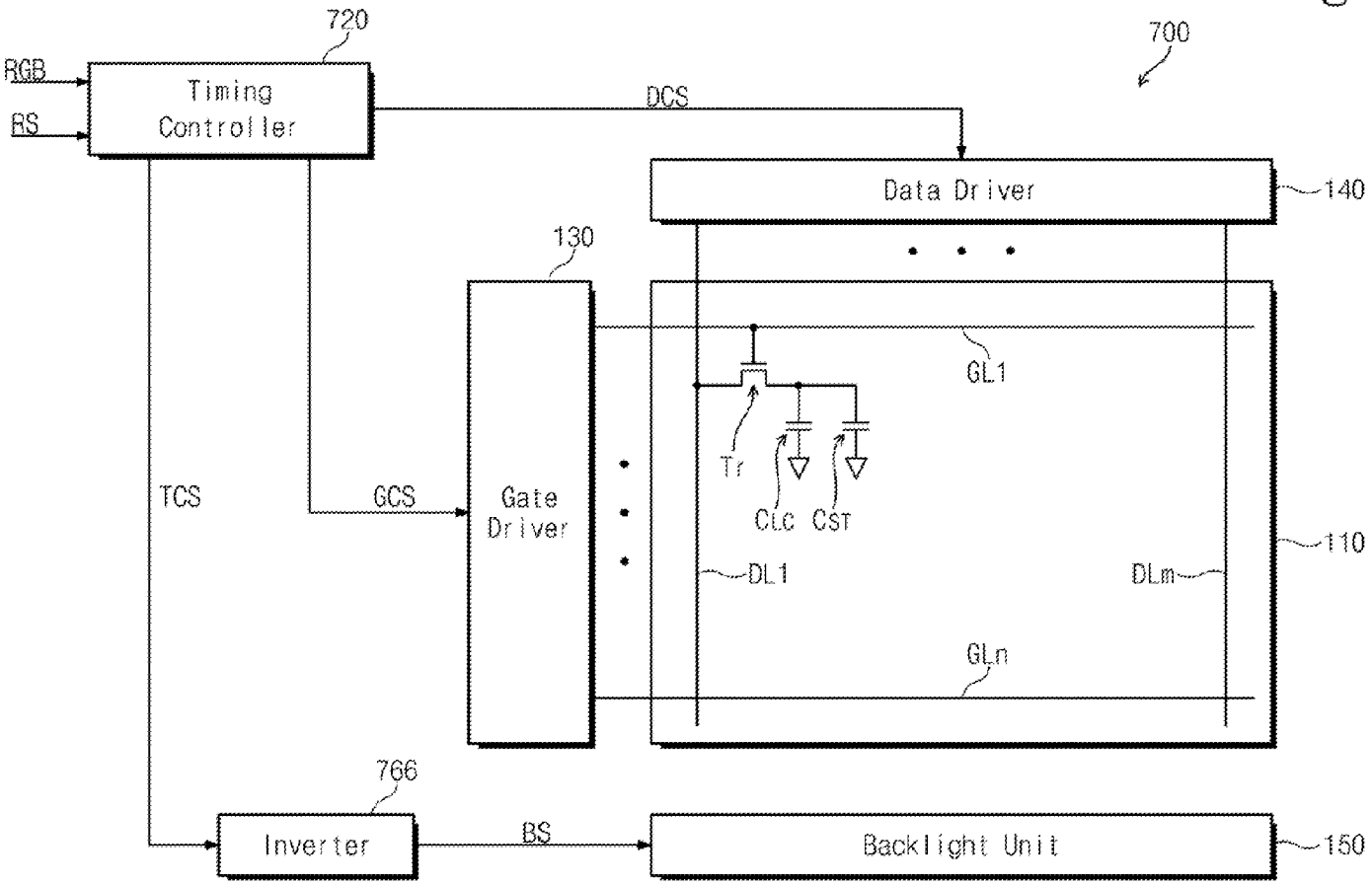
FIG. 7 is a block diagram showing a liquid crystal display according to another exemplary embodiment.

FIG. 7 is a block diagram of a liquid crystal display 700 according to another exemplary embodiment in accordance with the present disclosure of invention. In FIG. 7, the same reference numerals denote the same elements in FIG. 1, and thus detailed descriptions of the same elements will be omitted.

Referring to FIG. 7, the liquid crystal display 700 includes a liquid crystal display panel 110, a timing controller 720, a gate driver 130, a data driver 140, a backlight unit 150, and an inverter 766.

The timing controller 720 receives an image signal RGB and a reference signal RS from an external device (not shown). The reference signal RS may be a signal in synchronization with the frame rate of the liquid crystal display 100, such as a vertical synchronization signal or a horizontal synchronization signal. The timing controller 720 converts a data format of the image signal RGB into a data format appropriate to an interface between the timing controller 120 and the data driver 140 and outputs the converted image signal RGB, i.e. a data control signal DCS to the data driver 140. Also, the timing controller 720 outputs a gate control signal GCS to a gate driver 130.

Furthermore, the timing controller 720 internally detects an existence of a text information from an image signal corresponding to a predetermined text information area of the display panel 110 based on the image signal RGB and outputs a timing control signal TCS to synchronize a global blinking timing of the light sources with a liquid crystal response time of an image signal corresponding to a center portion or the text information area of the display panel 110 based on the detected result and the reference signal RS.

Particularly, the timing controller 720 defines a certain area of the display panel 110 as a to-be-tested for text area in order to detect the existence of possible text information in that area. The text information area is divided into n sub-areas, where n is an integer larger than two. The timing controller 720 extracts an image signal corresponding to each sub-area from the image signal RGB provided from the external device. Also, the timing controller 720 processes the extracted image signal to have a gamma value higher than an original gamma value of the extracted image signal and converts the processed image signal to an image signal in frequency domain, and decides whether the text information exists in each sub-area based on the frequency domain image signal. In this case, the timing controller 720 decides that the text information exists if at least one maximal value of the converted image signal corresponding to at least one sub-area is larger than a predetermined reference value. Then, the timing controller 720 provides the inverter 266 with the timing control signal TCS in accordance with the determined position of the to-be-most-clearly-presented text information to thereby make the blinking timing of the light sources synchronized with the liquid crystal response time of the image signal corresponding to the center portion or the text information-containing area of the display panel 110.

The inverter 766 blinks the light sources at once in synchronization with the liquid crystal response time of the image signal of the text information area in response to the timing control signal TCS.

Although the exemplary embodiments in accordance with the present teachings have been described, it is understood that the present teachings should not be limited to these exemplary embodiments but various changes and modifications can be made by one ordinary skilled in the art in light of the foregoing and as within the spirit and scope of the present disclosure.

What is claimed is:

1. A liquid crystal display comprising:

a display panel structured to display an image in response to gate line signals and data line signals;

a panel driving circuit structured to receive an image signal, structured to receive at least one control signal, and structured to provide the gate line signals and the data line signal to the display panel according to the image signal and the at least one control signal;

a backlight unit structured to provide illuminating light to the display panel for the display panel to display the image to a viewer of the display panel, the backlight unit including a plurality of light sources; and a backlight control circuit structured to detect existence of text information in the image signal, the backlight control circuit being further structured to determine a text information containing area where text in accordance with the text information will appear on the display panel, the backlight control circuit being further structured to determine a blinking-on timing of the light sources in accordance with the text information containing area, wherein the backlight control circuit is structured to output a timing control signal to synchronize the blinking-on timing of the plurality light sources, the timing control signal being delayed by a first time from a predetermined reference signal if the received image signal is determined to contain no text information, the timing control signal being delayed by a second time from the reference signal if the received image signal is determined to contain some text information in a position corresponding to the text information containing area, the second time being equal to or different from the first time.

2. The liquid crystal display of claim 1, wherein the backlight control circuit comprises:

a text information detector structured to detect the existence of the text information within the image signal, structured to determine a location of the text information containing area on the display panel, and structured to output a detection signal corresponding to the existence of the text information and the location of the text information containing area;

a blinking timing controller structured to output the timing control signal to synchronize the blinking-on timing of the light sources, based on liquid crystal response delay time of the display panel, with a timing at which the gate line signals and the data line signals are asserted corresponding to the text information in accordance with the detection signal output by the text information detector; and an inverter structured to simultaneously blink on all the light sources for a limited duration responsive to the timing control signal.

3. The liquid crystal display of claim 2, wherein a detection-operation area associated with the display panel is divided into n sub-areas, where n is an integer larger than 1, and the text information detector detects possible existence of the text information in each sub-area using a portion of the image signal corresponding to each sub-area to thus form and output the detection signal.

4. The liquid crystal display of claim 3, wherein the text information detector processes the image signal to generate a processed image signal that has a gamma value higher than an original gamma value of the image signal.

5. The liquid crystal display of claim 4, wherein the text information detector converts the processed image signal to a converted image signal in frequency domain before performing text information existence determination, where the text information existence determination is based on there being at least one maximal value of the converted image signal corresponding to at least one sub-area that is larger than a predetermined value.

6. The liquid crystal display of claim 2, wherein the blinking timing controller outputs the timing control signal delayed by a desired time from the predetermined reference signal synchronized with a frame rate of the display panel in response to the detection signal.

7. The liquid crystal display of claim 6, wherein the first time corresponds to the liquid crystal response time of the image signal corresponding to a center portion of the display panel, and the second time corresponds to the liquid crystal response time of the image signal corresponding to a different text information containing area.

8. The liquid crystal display of claim 7, wherein the text information area is located below the center portion, and wherein the second time is larger than the first time.

9. The liquid crystal display of claim 6, wherein the reference signal is a vertical synchronization signal.

10. A method of driving a liquid crystal display, the method comprising;

providing a display panel with gate signals and data signals based on an image signal and at least one control signal;

controlling orientation angles of liquid crystals using the gate signals and the data signals for displaying an image;

detecting existence of text information within the image signal;

determining a text information containing area where text in accordance with the text information will be displayed on the display panel;

generating a timing control signal, the timing control signal being delayed by a first time from a predetermined reference signal if the received image signal is determined to contain no text information, the timing control signal being delayed by a second time from the reference signal if the received image signal is determined to contain some text information in a position corresponding to the text information containing area, the second time being equal to or different from the first time; and blinking on a plurality of light sources simultaneously in accordance with the timing control signal and in accordance with the text information containing area.

11. The method of claim 10, wherein the detecting existence of text information comprises:

dividing a detection-operation area associated with the display panel into n sub-areas to detect text information presence in a portion of the image signal corresponding to each sub-area among the sub-areas; and deciding text information existence in the image signal corresponding to the text information containing area based on the text information presence corresponding to at least one sub-area among the sub-areas.

12. The method of claim 11, wherein the detecting existence of text information further comprises processing the received image signal corresponding to the at least one sub-area to generate a processed image signal that has a gamma value higher than an original gamma value of the image signal.

13. The method of claim 12, further comprising: converting the processed image signal to a converted image signal in a frequency domain before the detecting existence of text information, where a decision is based on whether at least one maximal value of the converted image signal corresponding to at least one sub-area is higher than a predetermined value.

14. The method of claim 10, wherein the predetermined reference signal synchronizes with a frame rate of the display panel in response to the detection signal, and wherein a blinking timing of the light sources is in synchronization with the liquid crystal response delay time of the liquid crystals in the corresponding text information containing area.

15. The method of claim 14, wherein the first time corresponds to the liquid crystal response time of the image signal corresponding to a center portion of the display panel, and the second time corresponds to the liquid crystal response time of the image signal corresponding to the text information area.

16. The method of claim 15, wherein the text information area is located below the center portion, and wherein the second time is larger than the first time.

17. The method of claim 14, wherein the reference signal is a vertical synchronization signal.

18. A liquid crystal display comprising:

a display panel structured to display an image in response to gate line signals and data line signals;

a backlight unit comprising a plurality of light sources, the light sources being structured to blink simultaneously to provide a light to the display panel; and a driving circuit structured to provide the gate line signals and the data line signals to the display panel using a received image signal and a received control signal, the driving circuit being structured to detect existence of text information in a portion of the received image signal and to determine a corresponding text information containing area of the display panel and to synchronize a blinking timing of the light sources in accordance with a liquid crystal response delay time of the liquid crystals, wherein the blinking timing is according to the detected result of the detection, and wherein the driving circuit is structured to output a timing control signal to synchronize a blinking-on timing of the plurality light sources, the timing control signal being delayed by a first time from a predetermined reference signal if the received image signal is determined to contain no text information, the timing control signal being delayed by a second time from the reference signal if the received image signal is determined to contain some text information in a position corresponding to the text information containing area, the second time being equal to or different from the first time.

19. The liquid crystal display of claim 18, further comprising an inverter structured to blink the light sources at once.

20. The liquid crystal display of claim 19, wherein a detection-operation area associated with the display panel is divided into n sub-areas, where n is an integer larger than 1, and the driving circuit detects text information presence in each sub-area among the sub-areas using a corresponding portion of the received image signal corresponding to each sub-area to decide that text information existence in the text information area based on the text information presence in at least one sub-area among the sub-areas.

* * * * *